US012571290B2

(12) United States Patent
Bosch et al.

(10) Patent No.: US 12,571,290 B2
(45) Date of Patent: Mar. 10, 2026

(54) METHODS OF GENERATING HYDROGEN IN HIGH-TEMPERATURE, TIGHT SUBTERRANEAN FORMATIONS

(71) Applicant: Halliburton Energy Services, Inc., Houston, TX (US)

(72) Inventors: Ronald Bosch, Houston, TX (US); Philip D. Nguyen, Houston, TX (US); Ronald Glen Dusterhoft, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/390,719

(22) Filed: Dec. 20, 2023

(65) Prior Publication Data

US 2025/0207485 A1 Jun. 26, 2025

(51) Int. Cl.

| | |
|---|---|
| ***E21B 43/247*** | (2006.01) |
| ***E21B 43/26*** | (2006.01) |
| ***E21B 43/267*** | (2006.01) |

(52) U.S. Cl.

CPC ..... *E21B 43/247* (2013.01); *E21B 43/2605* (2020.05); *E21B 43/267* (2013.01); *E21B 43/2607* (2020.05)

(58) Field of Classification Search

CPC .. E21B 43/247; E21B 43/2605; E21B 43/267; E21B 43/2607; E21B 43/26

See application file for complete search history.

(56) References Cited

U.S. PATENT DOCUMENTS

| | | | |
|---|---|---|---|
| 6,732,796 | B2 | 5/2004 | Vinegar et al. |
| 7,217,304 | B2 | 5/2007 | Deckman et al. |
| 7,331,179 | B2 | 2/2008 | Balan et al. |
| 7,448,214 | B2 | 11/2008 | Monostory et al. |
| 7,891,188 | B2 | 2/2011 | Zachar |
| 8,240,370 | B2 | 8/2012 | Palamara et al. |
| 8,414,666 | B2 | 4/2013 | Palamara et al. |

(Continued)

FOREIGN PATENT DOCUMENTS

| | | | |
|---|---|---|---|
| GB | 2628423 | A | 9/2024 |
| WO | 2011010113 | A2 | 1/2011 |

(Continued)

OTHER PUBLICATIONS

Karma Zuraiqi, Liquid Metals in Catalysis for Energy Applications, Joule Review, Nov. 18, 2020. pp. 2290-2321, Cell Press.

(Continued)

*Primary Examiner* — Crystal J Lee

(74) *Attorney, Agent, or Firm* — Conley Rose, P.C.; Rodney B. Carroll

(57) ABSTRACT

A method of producing hydrogen downhole in a subterranean reaction zone that employs fracturing a subterranean formation to provide fractures in the subterranean formation (e.g., to produce the subterranean reaction zone comprising fracture volume provided by the fractures), wherein the subterranean comprises a tight formation, and introducing one of more reactants downhole into the fractures (e.g., into the subterranean reaction zone), whereby hydrogen is produced by reaction of the one or more reactants in situ in the fractures (e.g., in situ in the reaction zone).

20 Claims, 5 Drawing Sheets

(56) References Cited

U.S. PATENT DOCUMENTS

| | | | | |
|---|---|---|---|---|
| 8,430,166 | B2 | 4/2013 | Danko | |
| 8,479,834 | B2 | 7/2013 | Preston | |
| 9,261,097 | B2 | 2/2016 | Moricca et al. | |
| 9,309,749 | B2 | 4/2016 | Kaminsky | |
| 10,429,533 | B2 | 10/2019 | Noui-Mehidi et al. | |
| 10,920,152 | B2 | 2/2021 | Snow et al. | |
| 10,927,604 | B2 | 2/2021 | Danko | |
| 10,982,517 | B2 | 4/2021 | Al-Mulhern et al. | |
| 11,155,462 | B2 | 10/2021 | Arkadakskiy et al. | |
| 11,530,603 | B2 | 12/2022 | Gates et al. | |
| 2005/0239661 | A1 | 10/2005 | Pfefferle | |
| 2006/0011472 | A1 | 1/2006 | Flick | |
| 2010/0288466 | A1 | 11/2010 | Danko | |
| 2010/0307756 | A1 | 12/2010 | Jung et al. | |
| 2010/0314105 | A1 | 12/2010 | Rose | |
| 2011/0272153 | A1 | 11/2011 | Boone et al. | |
| 2012/0199354 | A1 | 8/2012 | Kaminsky | |
| 2017/0335663 | A1 | 11/2017 | Dykstra et al. | |
| 2020/0182019 | A1 | 6/2020 | Wang et al. | |
| 2022/0034209 | A1 | 2/2022 | Hytken | |
| 2022/0034258 | A1 | 2/2022 | Aikman | |
| 2022/0251935 | A1* | 8/2022 | Vinegar | E21B 49/00 |
| 2022/0339609 | A1 | 10/2022 | Hu et al. | |
| 2023/0119784 | A1 | 4/2023 | Reinertsen et al. | |
| 2023/0323756 | A1* | 10/2023 | Darrah | E21B 43/00 |
| 2025/0003323 | A1* | 1/2025 | Yuan | E21B 43/40 |

FOREIGN PATENT DOCUMENTS

| | | | |
|---|---|---|---|
| WO | 2014039052 | A1 | 3/2014 |
| WO | 2019199433 | A1 | 10/2019 |
| WO | 2019224326 | A1 | 11/2019 |
| WO | 2021237137 | A1 | 11/2021 |

OTHER PUBLICATIONS

Hydrogen Storage, Wikipedia. Nov. 30, 2023. 34 pages.

Office of Energy & Renewable Energy, Hydrogen and Fuel Cell Technologies Office. Hydrogen Storage, Nov. 30, 2023. 8 pages.

Loyd East Jr., "Methods for Enhancing Far-Field Complexity in Fracturing Operations," SPE Annual Technical Conference and Exhibition, Florence, Italy. Sep. 2010. pp. 291-303.

Filing Receipt and Drawings for U.S. Appl. No. 18/390,710, filed Dec. 20, 2023, titled "Storing and Manufacturing Hydrogen in Horizontally Drilled Wells," 70 pages.

Filing Receipt and Drawings for U.S. Appl. No. 18/210,211, filed May 15, 2023, titled "Optimizing Well Placement to Maximize Exposed Hydraulicfracture Area in Geothermal Wells," 58 pages.

R.D. Barree., "Stress Shadowing and Fracture Interference in GOHFER," White Paper, Halliburton Production Enhancement. May 30, 2015. 10 page.

1st Office Action dated Oct. 1, 2024. U.S. Appl. No. 18/210,211, filed Jun. 15, 2023, 20 pages.

Office Action dated Jan. 27, 2026 for U.S. Appl. No. 18/390,710, filed Dec. 20, 2025, 25 pages.

* cited by examiner

METHODS OF GENERATING HYDROGEN IN HIGH-TEMPERATURE, TIGHT SUBTERRANEAN FORMATIONS

TECHNICAL FIELD

The present disclosure relates generally to systems and methods for generating hydrogen downhole in tight subterranean formations. More specifically, this disclosure relates to systems and methods of producing hydrogen downhole by injecting one or more reactants downhole via one or more injection wells, whereby the one or more reactants participate in a hydrogen-producing reaction(s) within downhole fractures, and producing product comprising the hydrogen via one or more production wells and/or storing the product comprising the hydrogen downhole.

BACKGROUND

While some natural hydrogen does occur in different geological environments, commercial production of hydrogen is very limited. Hydrogen is typically generated using energy intensive processes that generate large quantities of carbon dioxide that add to the cost and expand the environmental footprint. Such processes include steam methane reforming, methane pyrolysis and catalytic methane pyrolysis, and water electrolysis, among others. Even green hydrogen that is generated by electrolysis of water to form hydrogen and oxygen requires an excessive amount of energy that significantly drives its cost up.

BRIEF SUMMARY OF THE DRAWINGS

For a more complete understanding of this disclosure, reference is now made to the following brief description, taken in connection with the accompanying drawings and detailed description, wherein like reference numerals represent like parts.

While embodiments of this disclosure are depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

Figure 3A:
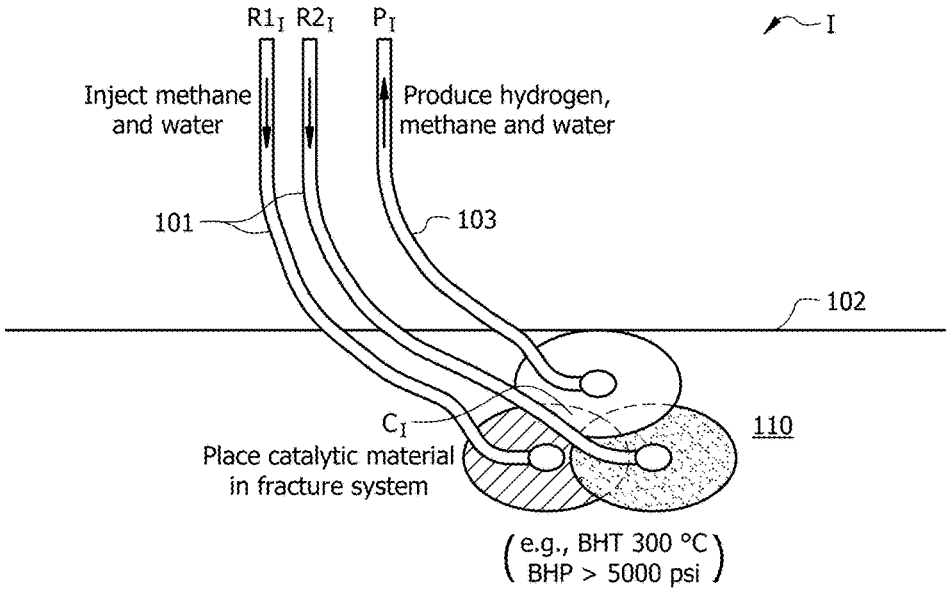
FIG. 3A is a schematic of a system I, according to embodiments of this disclosure.
Figure 3B:
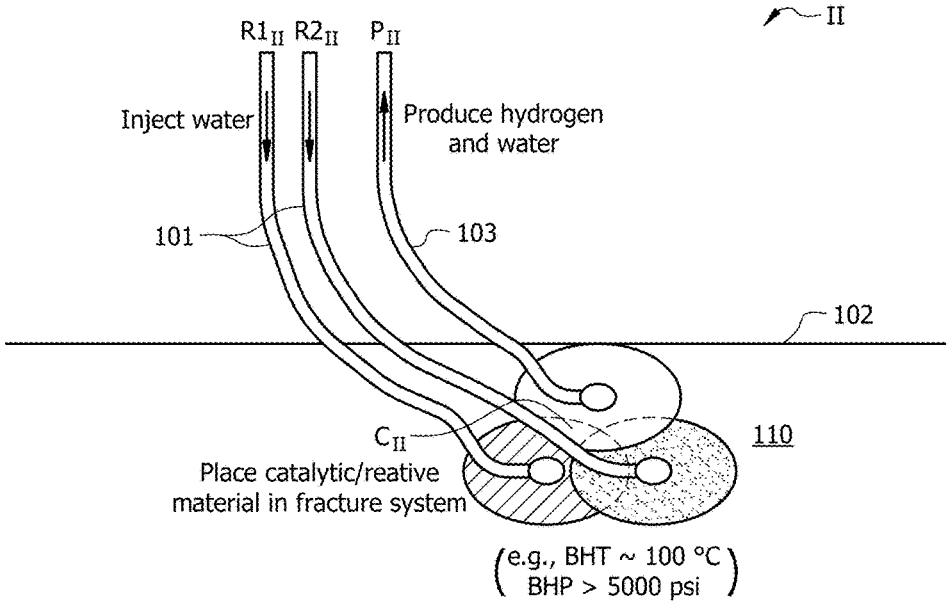
FIG. 3B is a schematic of a system II, according to embodiments of this disclosure.

Throughout this disclosure, a reference numeral followed by an alphabetical character refers to a specific instance of an element and the reference numeral alone refers to the element generically or collectively. Thus, as an example (not shown in the drawings), widget "la" refers to an instance of a widget class, which may be referred to collectively as widgets "1" and any one of which may be referred to generically as a widget "1". For example, reference to product P can include product $P_I$ of System I described herein, product P can include product $P_{II}$ of System II described herein, product P can include product $P_{III}$ of System III described herein, and/or product P can include product $P_{IV}$ of System IV described herein. Similarly, system 100 can include System I of FIG. 3A, System II of FIG. 3B, System III of FIG. 3C, System IV of FIG. 3D, and/or System V of FIG. 4.

As noted above, although some natural hydrogen does occur in different geological environments, commercial production of hydrogen is very limited. Conventional hydrogen production utilizes energy intensive processes that generate large quantities of carbon dioxide that add to the cost and expand the environmental footprint.

Via this disclosure, wells (e.g., horizontal wells, vertical wells) are drilled and completed in tight, hot formations with multiple hydraulic fractures to promote fluid communication between them, to minimize fluid loss to the formations, to maximize heat conductivity among the formations, formation fluids and injected fluids for enhancing in situ reactions that produce hydrogen downhole. The subsurface reactions between different fluids and potentially solids placed within the fracture system can be utilized to produce subsurface hydrogen. The herein disclosed hydrogen production system and method can enable large volumes of hydrogen to be recovered at a reasonable cost and with reduced environmental footprint relative to conventional systems and methods.

Via the system and method of this disclosure, the subsurface reservoir can be transformed into a reaction bed to produce hydrogen that can be produced to the surface. The produced hydrogen can be utilized to fuel a hydrogen economy.

This disclosure provides systems and methods of in situ generation and production of hydrogen by utilization of the available heat existing in a subterranean formation to enhance reaction between the formation fluids and injected fluids (e.g., reactants). Multiple (e.g., horizontal and/or vertical) injection wells and production wells can be drilled in high-temperature, tight formations (e.g., formations having low permeability, low porosity, and/or a high temperature (e.g., a bottom hole temperature (BHT) of about 100° C.-300° C.)) to transform them into downhole reactors. The wells can be completed with multiple hydraulic fractures to create conductive flow paths promoting fluid communication between the (e.g., propped) fractures and the wellbores, while minimizing fluid loss to the rock formations. In embodiments, a catalytic material can be injected as a proppant material, coated onto the proppant material, or mixed into the proppant material used as part of hydraulic fracturing treatments. In an embodiment, the proppant material is a catalytic proppant material that exhibits catalytic behavior effective to catalyze or promote one or more hydrogen producing reactions. For example, a catalytic proppant material may comprise a support (e.g., a porous support) and one or more catalytic compounds, elements (e.g., metals), or pendant groups disposed on and/or within the support. In an embodiment, the catalytic proppant material has sufficient crush strength to withstand the forces exerted upon the catalytic proppant material upon placement in the formation fracture, and is thereby effect to prop open the formation fractures to promote fluid flow of material therein (e.g., formation fluids, reactants, and/or reaction products). The catalyst can be selected to catalyze the downhole production of hydrogen via the hydrogen production reactions being utilized. The generated hydrogen can be separated from other fluids produced from the production well(s) to be collected for storage, or directly used, for example, as a fuel source for powering equipment, or being fed into a hydrogen fuel cell for generating electricity.

A system and method of this disclosure will now be described with reference to FIG. 1, which is a schematic flow diagram of a method 10 and FIG. 2 which is a schematic of a system 100, according to embodiments of this disclosure.

Figure 1:
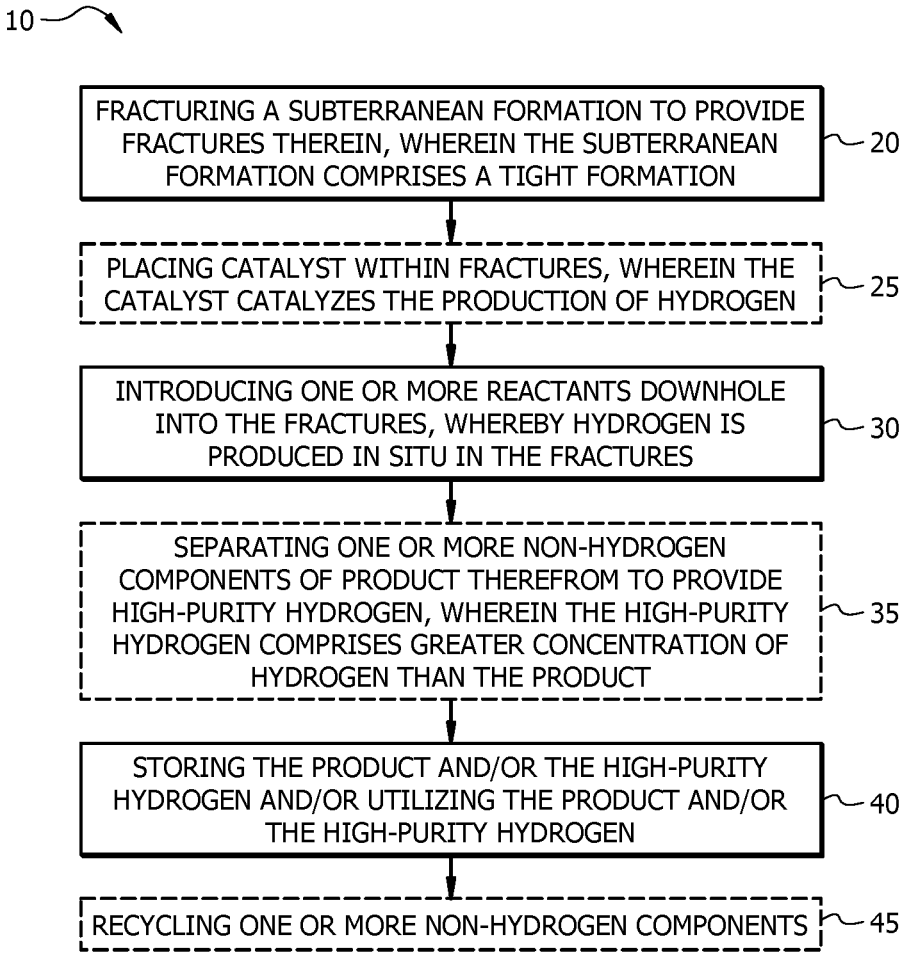
FIG. 1 is a schematic flow diagram of a method 10, according to embodiments of this disclosure.
Figure 2:
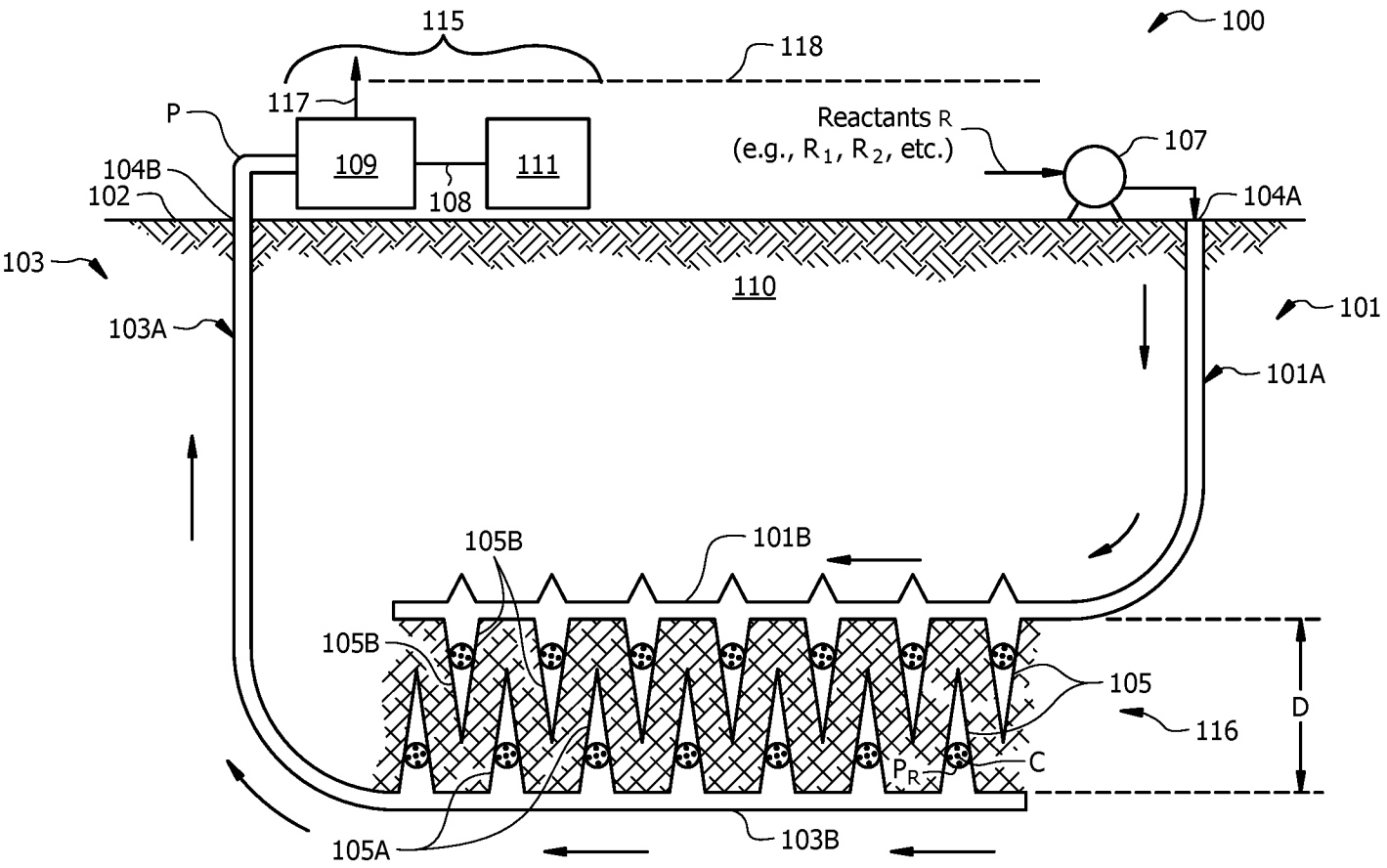
FIG. 2 is a schematic of a system 100, according to embodiments of this disclosure.

With reference to FIG. 1, method 10 of producing hydrogen downhole comprises: at 20, providing (e.g., fracturing) a subterranean formation to having (or to provide) fractures in the subterranean formation, wherein the subterranean comprises a tight formation; and, at 30, introducing one of more reactants downhole into the fractures, whereby hydrogen is produced in situ in the fractures. The hydrogen can be produced in the fractures via reaction of the one or more reactants introduced downhole, which reactants may, in embodiments, be transformed via passage downhole (e.g., water introduced into an injection well can be converted to steam at downhole temperature and pressure), optionally with one or more additional reactants already present in the downhole environment (e.g., one or more additional reactants not introduced downhole via an injection well), to produce hydrogen via one or more hydrogen production reactions, optionally in the presence of a catalyst that catalyzes the hydrogen production reaction(s).

The method of this disclosure can further comprise, as depicted at 25, placing a catalyst within at least a portion of the fractures in the subterranean formation, wherein the catalyst catalyzes the production of hydrogen; as depicted at 35, separating one or more non-hydrogen components of a product comprising the hydrogen to provide a high-purity hydrogen comprising at least a portion of the hydrogen produced via the hydrogen production reaction(s), wherein the high-purity hydrogen comprises a greater concentration of hydrogen than the product; as depicted at 40, storing the product and/or the high-purity hydrogen and/or utilizing the product and/or the high-purity hydrogen; and/or, as depicted at 45, recycling one or more non-hydrogen components.

FIG. 1 is a schematic diagram illustrating a system 10 of wellbores and propped fractures 105 in a tight subterranean formation 110, in accordance with embodiments of the present disclosure. The subterranean formation 110 includes a production wellbore 103 that has been drilled from location 104B on the surface 102 to penetrate at least a portion of the formation 110. As shown, production wellbore 103 includes at least one substantially vertical portion 103*a* extending from location 102 at the surface and at least one substantially horizontal portion 103*b* that extends from the bottom of the vertical portion 103*a*. The production wellbore 103 may be coupled to downstream apparatus 115 (e.g., comprising a separation apparatus 109, and hydrogen usage apparatus 111, for example and without limitation, a turbine or other power or electricity generating apparatus). The subterranean formation 110 also includes an injection wellbore 101 that has been drilled from a location 104A at the surface 102 to penetrate at least a portion of the formation 110.

Fracturing the subterranean formation 110 at 20 can comprise: drilling one or more injection wells 101; drilling one or more production wells 103; and producing fractures 105 in the subterranean formation 110 by fracturing the one or more injection wells 101, the one or more production wells 103, or both, such that the fractures 105 extend within the subterranean formation 110 in an area 116 between each of the one or more injection wells 101 and at least one of the one or more production wells 103. The complex network of fractures 105 provides a large surface area for capture of in situ heat (from tight formation 110) for promoting the downhole hydrogen production reactions.

As shown, injection wellbore 101 can include at least one substantially vertical portion 101*a* extending from the surface at location 104A and at least one substantially horizontal portion 101*b* that extends from the bottom of the vertical portion 101*a*. Further, the injection wellbore 101 may be coupled to an injection pump 107. In embodiments, the horizontal portion 103*b* of the production wellbore 103 may be substantially parallel to the horizontal portion 101*b* of the injection wellbore 101. In embodiments, the horizontal portions 101*b* and 103*b* of the injection wellbore 101 and the production wellbore 103, respectively, may be within a range of 50 to 1000 feet (e.g., distance D in FIG. 2) of one another. Although depicted as having vertical and horizontal portions, injection well(s) 101 and production well(s) 103 can include horizontal and/or vertical portions.

In embodiments, the fractures 105 may be created and/or propped via both the injection wellbore 101 and the production wellbore 103. In embodiments, the fractures 105 may be created in parallel to one another. In embodiments, the fractures may be created such that each primary fracture generated by one wellbore is located between, or in close proximity to, two primary fractures generated by the other wellbore, as depicted in the embodiment of FIG. 2.

Fracturing the formation at 20 can comprise introducing a fracturing fluid comprising a proppant $P_R$ into the subterranean formation 110, wherein proppant $P_R$ props open at least a portion the fractures 105. As discussed further hereinbelow, the proppant $P_R$ can be coated with a catalyst C that catalyzes one or more reactions that produce the hydrogen.

In embodiments, a proppant slurry comprising a heat-activating resin may be used to create and/or prop one or more fractures 105. The formation may heat the resin, thereby activating a polymerization reaction within the resin. The polymerized resin may enhance one or more of wellbore-wall stabilization, formation-wall stabilization, and thermal conductivity. Further, the polymerized resin may transform the loose proppant into consolidated, permeable packs, which may hold the propped fractures 105 open during fluid transport.

In embodiments, one or more reactants R (e.g., $R_1$, $R_2$, etc.) may be injected into an injection wellbore 101 and may travel to one or more propped fractures 105 to absorb heat in the rock formation 110 and react to produce hydrogen in situ. As noted above and described further hereinbelow with respect to particular exemplary embodiments, one or more additional reactants (e.g., methane, water, etc.) for the hydrogen production reaction(s) can be present downhole in the formation 110, and need not be (or need not completely be) introduced from surface 102. Subsequently, a high-temperature product 120 comprising the hydrogen may travel from the propped fractures 105 to a production wellbore 103 for storage and/or production. In embodiments, the product 120 can be used to generate electricity and/or to fuel hydrogen-fueled apparatus (e.g., hydrogen usage apparatus 111).

As noted above, in embodiments of the present disclosure, a proppant $P_R$ can be utilized. Examples of proppant materials that may be suitable in embodiments include, but are not limited to, silica (sands), graded sands, Ottawa sands, Brady sands, Colorado sands; resin coated sands; gravels; synthetic organic particles, nylon pellets, high density plastics, polytetrafluoroethylenes, rubbers, resins; ceramics, aluminosilicates; glass; sintered bauxite; quartz; aluminum pellets; ground or crushed shells of nuts, walnuts, pecans, almonds, ivory nuts, brazil nuts, and the like; ground or crushed seed shells (including fruit pits) of seeds of fruits, plums, peaches, cherries, apricots, and the like; ground or crushed seed shells of other plants (e.g., maize, corn cobs or corn kernels); crushed fruit pits or processed wood materials, materials derived from woods, oak, hickory, walnut, poplar, mahogany, and the like, including such woods that have been processed by grinding, chipping, or other techniques for forming particles; or combinations thereof. It is within the ability of one skilled in the art, with the benefit of this disclosure, to select one or more suitable proppants for use in embodiments of the present disclosure. In embodiments, the particle size of the proppant introduced into the formation 110 is gradually increased from medium-to coarse-sized fracturing sand or other proppant. The gradual increase in particle size may facilitate placement of the particles in the dominant fracture and larger branches. In embodiments, the proppant may be mixed with a fracturing fluid to produce a proppant slurry.

The proppant $P_R$ may serve, among other purposes, to prop open fractures 105, thereby maintaining the integrity of a formation 110, allowing fluid (e.g., reactants and/or product) to pass through the propped area, and/or conducting heat. After the proppant $P_R$ is introduced into the formation, the fracture may be allowed to close and hold the proppant in place between the fracture faces. In embodiments, some or all of the proppant $P_R$ may be pre-coated; in embodiments, the proppant $P_R$ may not be pre-coated. In embodiments, the proppant $P_R$ may be incorporated into a thermally conductive composition by coating the proppant with a thermally conductive resin composition. In embodiments, the proppant itself may be thermally conductive. In embodiments, as discussed further hereinbelow, the proppant $P_R$ can comprise or be coated with a catalyst C that catalyzes the production of hydrogen in situ in the fractures 105.

A darcy unit (D), a millidarcy (mD), a microdarcy (uD), and nanodarcy (nD) are units of permeability to describe the ability of fluids to flow through porous media, e.g., rock. The darcy unit is dimensionless and defined using Darcy's law. For example, a porous structure, e.g., porous medium, with a permeability of 1 darcy permits a flowrate of 1 cubic centimeter per second ($cm^3/s$) of a fluid with viscosity of 1 centipoise (cP) under a pressure gradient of 1 atmosphere per centimeter (atm/cm) acting across an area of 1 square centimeter ($cm^2$). According to this disclosure, subterranean formation 110 is a tight formation 110. In an aspect, tight formation 110 has a permeability of less than or equal to about 0.0001, 0.1, 3, or 10 microDarcy (μD), a porosity of less than or equal to about 2, 4, or 6%, or a combination thereof. In an aspect, the subterranean formation 110 is a non-permeable formation (e.g., a non-permeable, tight formation), has a porosity of less than or equal to about 2, 4, or 6%, or a combination thereof. As used herein, the term non-permeable formation will refer to a formation with a permeability of less than 10 μD, alternatively of less than 3 μD, alternatively in a range of equal to or less than 0.1 mD to about 0.1 nD, alternatively in a range of equal to or less than about 10 μD to about 0.1 nD, alternatively in a range of equal to or less than about 10 μD to about 0.01 nD, alternatively in a range of equal to or less than about 3 μD to about 0.01 nD, or alternatively in a range of equal to or less than about 3 μD to about 0.1 nD, for example, as found in granite or tight shale formations.

When fracturing tight formations (e.g., non-permeable formations), the fractures in the area between the injection well(s) 101 and the production well(s) 103 can act as a high surface area reactor, with the fractures provided a large surface area for reactions to occur to produce hydrogen and heat to be absorbed from the hot formation 110 to promote the hydrogen production reaction(s). For example, the fractures 105 can be exposed to a formation temperature (e.g., a bottom hole temperature (BHT)) of greater than or equal to about 100° C., 150° C., 200° C., 250° C., or 350° C. (e.g., from about 200 to about 250° C., from about 250° C. to about 300° C., or from about 300° C. to about 350° C.), a pressure (e.g., a bottom hole pressure (BHP)) of greater than or equal to about 5000, 10000, 15000, or 25000 psi (e.g., from about 5000 to about 10000 psig, from about 10000 to about 15000 psig, or from about 15000 psig to about 25000 psig), or a combination thereof.

As noted above and indicated at 25 of FIG. 1, the method 10 can include placing the catalyst C within at least the portion of the fractures 105 in the subterranean formation 110. The placing of the catalyst C can be effected during and/or subsequent fracturing the subterranean formation 110. For example, in embodiments, the proppant utilized during fracturing of the injection well(s) 101, the production wellbore(s) 103, or both is coated or otherwise contains catalyst C. Alternatively or additionally, catalyst C for catalyzing the reaction(s) for the production of hydrogen in situ in the fractures 105 is introduced downhole from surface 102 separately from or in combination with the one or more reactants R. Such catalyst C can comprise, for example, a nickel-based catalyst, an iron-based catalyst, a cobalt-based catalyst, a metal hydroxide catalyst, a metal oxide catalyst, or a combination thereof.

As noted above and indicated at 30, the method 10 can include introducing one or more reactants R (e.g., a first reactant R1, a second reactant R2, etc.) downhole. The one or more reactants R can be introduced downhole together or separately. Depending on the hydrogen production reactions being targeted, the one or more reactants R can include, for example and without limitation, water (e.g., liquid water and/or steam), hydrocarbons (e.g., methane), carbon dioxide ($CO_2$), oxygen ($O_2$), carbon monoxide (CO), etc., as described further hereinbelow with reference to the example systems I-IV of FIGS. 3A-3D, respectively.

The method 10 can further comprise, as indicated at 35, separating one or more non-hydrogen components of the product P therefrom to provide high-purity hydrogen 108. The high-purity hydrogen can comprise a greater concentration of hydrogen (and/or a lower temperature fluid stream) than the product P. Separating one or more non-hydrogen components of the product from the product to provide high-purity hydrogen can be effected downhole (e.g., via the area 116 of the formation 110, which can contain a bed of material for effecting the separation of one or more non-hydrogen components from the product P) and/or can be effected subsequent recovering the product comprising at least a portion of the hydrogen produced in the fractures 105 from downhole.

In embodiments, the plurality of fractures 105 comprise injection well fractures 105A associated with the one or more injection wells 101 and production well fractures 105B associated with the one or more production wells 103. Method 10 can comprise utilizing a portion of the formation 110 in the area 116 between the injection well(s) and the production well(s) and/or a bed of material positioned between the injection well fractures 105A, and production well fractures 105B to separate or remove one or more non-hydrogen components from the product prior to entry thereof into the one or more production wells 103.

In embodiments, separating of the one or more non-hydrogen components from the product at 35 can be effected via condensation, pressure swing adsorption (PSA), membrane separation, selective catalytic reaction(s), or a combination thereof. For example, in embodiments, the product 120 recovered above surface 102 comprises $H_2O$, and separating of the one or more non-hydrogen components 117 from the product 120 comprises cooling the product to condense water from the product 120. Such cooling can be combined with power generation, for example, via the use of an organic Rankine cycle waste heat recovery system and/or turning a turbine to generate electrical power directly, and/or passing the product through one or more heat exchangers (e.g., and optionally using the heat to generate electrical power)). Accordingly, separator 109 can be configured for separating one or more non-hydrogen components and/or heat of the product 120 therefrom to provide a high-purity hydrogen 108 comprising at least a portion of the hydrogen in the product, wherein the high-purity hydrogen comprises a greater concentration of hydrogen than the product. Separator 109 can comprise a condenser, a pressure swing adsorption (PSA) apparatus, a membrane, a selective catalytic reactor, or a combination thereof. Separator 109 can further comprise power generation apparatus configured to produce power from the heat of product 120. As noted, the power generation apparatus can comprise an organic Rankine cycle waste heat recovery system and/or a turbine configured to generate electrical power directly, and/or one or more heat exchangers.

Heat can be recovered from the product P (e.g., $P_I$, $P_{II}$, $P_{III}$, $P_{IV}$). The product P can be utilized for electrical production (e.g., via heat recovery, steam production, driving turbine, etc.). The hydrogen production can be combined with geothermal energy, by utilizing the heat of the product P for energy production. For example, in embodiments, the product P can be utilized in a binary cycle process, by passing the product through a heat exchanger. A secondary fluid with a lower boiling point than water (e.g., isobutane, pentane, or carbon dioxide) can be vaporized on the low temperature side of the heat exchanger and expanded through a turbine to generate electricity.

As depicted at 40, the method 10 can include storing the product P and/or the high-purity hydrogen 108 separated therefrom in separation apparatus 109, and/or utilizing, in usage apparatus 111, the product P and/or the high-purity hydrogen 108 separated therefrom in separation apparatus 109. At least a portion of the hydrogen 108 from and/or the product 120 can be stored, for example, in a storage well (e.g., in a production well 103 prior to production therefrom). In embodiments, at least a portion of the hydrogen 108 from and/or the product 120 can be utilized in a hydrogen usage apparatus 111. For example, the product 120 and/or the hydrogen 108 separated therefrom can be utilized as a fuel. For example, the $H_2$ 108 can be combusted as a fuel for powering a hydrogen usage apparatus 111 comprising a combustion engine. For example, the hydrogen 108 can be utilized for fueling hydrogen usage apparatus 111 comprising wellbore servicing equipment at a wellsite, in embodiments. At least a portion of the $H_2$ 108 separated from the product 120 can be utilized in a hydrogen usage apparatus 111 comprising a fuel cell. Such fuel cell can be utilized, for example, for generating electricity. For example, hydrogen 108 can be utilized to re-fuel a hydrogen fuel cell, such as a fuel cell utilized as an automobile fuel cell. At least a portion of the $H_2$ 108 from and/or the product 120 can be utilized in hydrogen usage apparatus 111 comprising an industrial system/process (e.g., for the production of one or more chemicals). At least a portion of the high-purity $H_2$ 108 can be utilized for re-filling fuel cells subsequently utilized to produce electricity to power e-frac systems to fracture gas wells (e.g., to produce methane). Numerous downstream equipment 111 can utilize the product 120 and/or the hydrogen 108 separated therefrom in separator 109, and the above are given by way of examples.

In embodiments, the product P (or a component, such as $CO_2$, separated therefrom) can be utilized to "sweep" hydrocarbons from the tight formation 110 and recover hydrocarbons along with reaction products (e.g., hydrogen, $CO_2$, etc.). In this manner, enhanced oil recovery (EOR) can be combined with in situ hydrogen production via embodiments of the systems and methods of this disclosure.

In embodiments, the produced hydrogen 108 can be stored (e.g., in a hydrogen container, as a metal hydride, or in specially completed wells drilled for hydrogen storage), until needed. The produced hydrogen (e.g., from the storage or immediately after production) can be fed to hydrogen fuel cells (e.g., hydrogen usage apparatus 111) when needed for generating electricity or for charging batteries, to power oilfield equipment in applications that require (e.g., remote) power, such as drilling, cementing, completions, stimulation, rework production, production treatment, water treatment, etc.

As depicted at 45, method 10 can further comprise recycling and/or further utilizing one or more of the non-hydrogen components separated from the product 120. For example, the method 10 can comprise reintroducing at least one of the one or more non-hydrogen components 117 (e.g., catalyst, unreacted reactant(s), CO, $CO_2$, $H_2O$, hydrocarbons, as further described in the exemplary embodiments described hereinbelow with reference to Systems I-IV of FIGS. 3A-3D, respectively) downhole during formation of additional hydrogen in the fractures 105. For example, in embodiments, $CO_2$ separated as a non-hydrogen component 117 can be recycled to the process, and/or injected into a wellbore for enhanced oil recovery techniques; or a combination thereof.

Example reactants R and reactions by which such example reactants R can be employed to produce hydrogen in situ in the fractures 105 will now be provided. These examples are not intended to be limiting, as other reactants R and reactions can be utilized to produce hydrogen downhole and may be apparent to one of skill in the art upon reading this disclosure.

Embodiment I

This Embodiment I enables producing hydrogen downhole via Steam Methane Reforming (SMR). With reference to the embodiment of FIG. 3A, which is a schematic of a system I according to embodiments of this disclosure, a system I can include one or more injection wells 101 and one or more production wells 103. System I can be a system 100 as described with reference to FIG. 2 above, further characterized as described hereinbelow. In these embodiments, the one or more reactants R (e.g., a first reactant R1) can comprise water ($H_2O$), and the hydrogen can be produced in the fractures 105 via reaction of $H_2O$ with methane via steam methane reforming (SMR) represented by Eq. (1):

$$CH_4+H_2O \rightarrow CO+3H_2. \quad \text{(Eq. 1)}$$

In embodiments, a mixture of methane and water can be injected into the injection wells 101. Methane gas can be obtained, for example, from natural gas, biogas, or other methane-rich sources, and the water-rock interaction can allow water to adsorb heat from the formation 110 to transforms it into steam. The high temperature and the presence of the catalyst $C_I$ (described hereinbelow) can facilitate the reaction between methane and steam according to Eq. (1).

The carbon monoxide produced via the steam methane reforming reaction (Eq. 1) can further react with water/steam (introduced as first reactant $R1_I$ and/or formation water/steam present in the formation 110) via the water gas shift reaction (WGSR) of Eq. (2) to produce additional hydrogen:

$$CO+H_2O \rightarrow CO_2+H_2, \quad \text{(Eq. 2)},$$

such that a net reaction can be represented by Eq. (3):

$$CH_4+2H_2O \rightarrow CO_2+4H_2. \quad \text{(Eq. 3)}$$

In some such embodiments, the one or more reactants R introduced downhole further comprise methane (e.g., second reactant $R2_I$ can comprise methane), the subterranean formation 110 can already contain methane, or the one or more reactants R introduced downhole can include methane and the subterranean formation 110 inherently comprises methane. That is, the methane can be introduced as a reactant R, and/or can be present in the subterranean formation 110 without being introduced downhole. The water $R1_I$ and methane $R2_I$ can be introduced together or separately.

A product $P_I$ comprising at least a portion of the hydrogen produced in situ in the fractures 105 an be recovered from one or more production well 103. The product $P_I$ can optionally further comprises unreacted methane, $H_2O$ (e.g. steam, water), carbon monoxide, carbon dioxide, or a combination thereof. In embodiments, the production of the hydrogen in the fractures 105 via the reaction of Eq. 3 can be catalyzed by a catalyst $C_I$ that catalyzes the production of hydrogen via reaction of Eq. (1) and/or the reaction of Eq. (2). For example, the catalyst $C_I$ can comprise a nickel-based catalyst, an iron-based catalyst, a cobalt-based catalyst, or a combination thereof. In such embodiments, the method can further comprise positioning the catalyst $C_I$ in at least a portion of the fractures 105. As described hereinabove, the catalyst $C_I$ can be introduced into the fractures 105 during and/or subsequent fracturing of the wells, for example with proppant $P_R$.

In this embodiment I, the fractures 105 can be exposed to a formation 110 temperature (e.g., a bottom hole temperature (BHT)) of greater than or equal to about 200° C., 250° C., or 350° C. (e.g., from about 200 to about 250° C., from about 250° C. to about 300° C., or from about 300° C. to about 350° C.), a pressure (e.g., a bottom hole pressure (BHP)) of greater than or equal to about 10000, 15000, or 25000 psi (e.g., from about 5000 to about 10000 psig, from about 10000 to about 15000 psig, or from about 15000 psig to about 25000 psig), or a combination thereof.

After the reaction, the components of the product $P_I$, including hydrogen ($H_2$), carbon monoxide (CO), carbon dioxide ($CO_2$), unreacted methane, and remaining steam, can exit through the production well(s) 103. The product $P_I$ mixture can be cooled to condense and separate the water vapor (steam) from the gases. This cooling process may include power generation through the use of organic Rankine cycle waste heat recovery systems or in some cases may be suitable to turn a turbine and generate electrical power directly. Condensation can be achieved by using cooling systems or passing the gases through heat exchangers where this heat can be captured and used to generate electrical power.

Hydrogen can be separated from the other remaining gases, including carbon monoxide, carbon dioxide, and unreacted methane, to obtain high-purity hydrogen 108. As noted hereinabove, various purification techniques can be employed, such as pressure swing adsorption (PSA), membrane separation, or selective catalytic reactions to remove impurities. The purified hydrogen can be stored and utilized for various applications, such as a fuel for powering combustion engines, fuel cells for generating electricity, industrial processes in generating chemicals or products, or supporting transportation. One or more of the separated carbon monoxide, carbon dioxide, methane, and water can be reinjected into injection well(s) 101 for continuing the process.

The steam-to-methane ratio can be adjusted for optimal performance. A ratio of approximately 3:1 (steam to methane) can be utilized. As noted, a nickel-based catalyst $C_I$, or another suitable catalyst, can be used to enhance the kinetics of the steam-methane reaction Eq. (1).

Embodiment II

The Embodiment II provides for downhole aluminum hydroxide hydrogen generation. With reference to the embodiment of FIG. 3B, which is a schematic of a system II according to embodiments of this disclosure, a system II can include one or more injection wells 101 and one or more production wells 103. System II can be a system 100 as described with reference to FIG. 2, further characterized as described hereinbelow.

Embodiment II can include methods and wellbores designed as in-situ reactors for generating hydrogen by splitting of water via a catalytic reaction of aluminum metal particulates in water at ambient or slightly higher temperature in the presence of metal hydroxide or oxide acting as a catalyst in one or more injection wells to produce hydrogen gas and byproduct aluminum oxide (and/or aluminum hydroxide) solids.

In these embodiments, the one or more reactants R (e.g., a first reactant $R1_{II}$ and a second reactant $R2_{II}$) can comprise aluminum particulates (e.g., aluminum particulates having a high surface to volume ratio (e.g., a surface to volume ratio of greater than or equal to about 0.1, 0.5, 1, 2, 3, 4, 5, or 6, or from about 0.1 to about 10, from about 0.1 to about 6, or from about 0.1 to about 2, from about 2 to about 4, or from about 4 to about 6), such as aluminum flakes, sawdust, milling shavings, chips, pellets, powder, or a combination thereof) and water. Hydrogen can be produced downhole via catalytic reaction of aluminum with water in the presence of a catalyst comprising metal hydroxide, metal oxide, or a combination thereof. The water can be introduced downhole with the aluminum particulates (e.g., aluminum nanoparticles), and/or can be present downhole (e.g., formation water) and need not be (entirely) introduced from surface 102.

The equations below show potential catalytic reactions of aluminum in water in presence of catalyst (e.g., metal hydroxide). In these embodiments, catalytic reaction of aluminum with water can be as represented by:

$$2Al+3H_2O \rightarrow Al_2O_3+3H_2; \quad \text{(Eq. 4)}$$

$$2Al+6H_2O \rightarrow 2Al_2O_3+3H_2; \quad \text{(Eq. 5)}$$

or a combination thereof.

The metal hydroxide can be selected from sodium hydroxide, potassium hydroxide, calcium hydroxide, magnesium hydroxide, or a combination thereof; the metal oxide can be selected from sodium oxide, potassium oxide, calcium oxide, magnesium oxide, or a combination thereof, or the metal hydroxide can be selected from sodium hydroxide, potassium hydroxide, calcium hydroxide, magnesium hydroxide, or a combination thereof and the metal oxide can be selected from sodium oxide, potassium oxide, calcium oxide, magnesium oxide, or a combination thereof.

The method can include recovering a product $P_{II}$ from the one or more production wells 103, the product $P_{II}$ comprising at least a portion of the hydrogen produced in the fractures 105. The product $P_{II}$ can further comprise aluminum oxide solids, aluminum hydroxide solids, $H_2O$ (e.g. steam, water), or a combination thereof.

In such embodiments utilizing a system II, a method can comprise: providing a source of freshwater (e.g., to be injected as a reactant $R2_{II}$ or already in situ in the formation 110); a source of aluminum particulates $R1_{II}$; a source of catalyst Cu (e.g., metal hydroxide); introducing (e.g., injecting) an aqueous-based solution containing the catalyst Cu (e.g., liquid metal hydroxide) into injection well(s) 101; introducing (e.g., injecting) a slurry comprising (e.g., a known concentration of) the aluminum particulates $R1_{II}$ (e.g., aluminum nanoparticles) in (e.g., an aqueous or a non-aqueous (e.g., ethylene glycol)) carrier fluid into the injection well(s) 101; allowing the catalytic reaction of Eq. (4) and/or Eq. (5) to occur between the aluminum particulates and water in the presence of the catalyst Cu to produce the hydrogen as a gas and byproduct aluminum oxide and/or aluminum hydroxide solids; and producing a product $P_{II}$ comprising $H_2O$ and at least a portion of the hydrogen via a production well(s) 103. The water can be separated from the product Pu to provide high-purity hydrogen. The product $P_{II}$ can further comprise at least a portion of the byproduct aluminum oxide and/or aluminum hydroxide solids, which can be separated from the hydrogen with the produced water. The method can include injecting additional water and aluminum particulates downhole to maintain a target hydrogen production rate and/or temperature in the fractures 105 to maintain the catalytic reaction for substantially continuous and constant production of hydrogen gas while removing the aluminum oxide (or aluminum hydroxide) solids.

In embodiments, the fractures 105 can be exposed to a formation 110 temperature (e.g., a bottom hole temperature (BHT)) of greater than or equal to about 100° C., 150° C., 200° C., or 250° C. (e.g., from about 100 to about 150° C., from about 150° C. to about 200° C., or from about 200° C. to about 250° C.), a pressure (e.g., a bottom hole pressure (BHP)) of greater than or equal to about 5000, 10000, or 15000 psi (e.g., from about 5000 to about 7500 psig, from about 7500 to about 10000 psig, or from about 10000 psig to about 15000 psig), or a combination thereof.

As with the other embodiments described herein, the produced hydrogen gas can be utilized as a fuel source for hydrogen fuel cells or internal combustion engines, to produce electricity and/or to directly power pumps. The produced electricity can be utilized to directly power oilfield equipment or to charge the batteries.

As noted above, a source of aluminum particulates $R1_{II}$ can be prepared as a slurry form prior to injecting into the injection well(s) 101. The aluminum slurry can comprise an aqueous (e.g., freshwater), or a non-aqueous (e.g., ethylene glycol) liquid, and a known concentration of aluminum particulates. The aluminum particulates can be in the forms of flakes, sawdust, milling shavings, chips, pellets, powder, or other similar small particulates having a large surface over volume ratio.

It is noted that powdered aluminum can be dangerous to deal with at the surface 102, and carrying out the hydrogen production reactions of Eq. (4) and Eq. (5) downhole provide the added benefit of a safer working environment.

Embodiment III

Figure 3C:
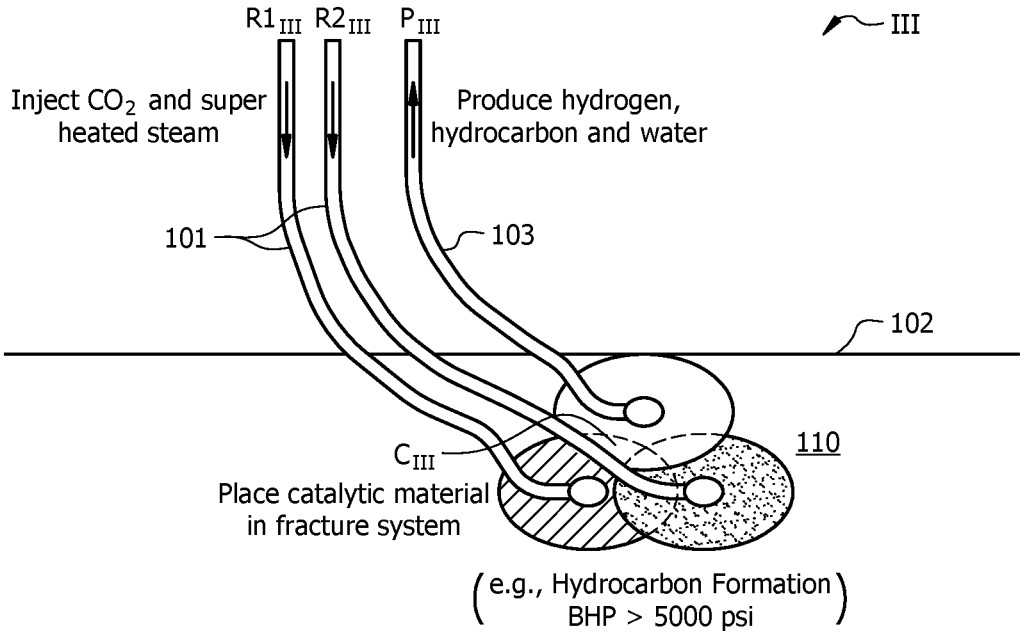
FIG. 3C is a schematic of a system III, according to embodiments of this disclosure.

With reference to the embodiment of FIG. 3C, which is a schematic of a system III according to embodiments of this disclosure, a system III can include one or more injection wells 101 and one or more production wells 103. System III can be a system 100 as described with reference to FIG. 2, further characterized as described hereinbelow.

In these embodiments, reactants R including a mixture of $CO_2$ (as first reactant $R1_{III}$) and steam (as second reactant $R1_{III}$) can be injected into the injection well(s) 101. The $CO_2$ can be obtained from various sources, such as flue gas (e.g., of industrial processes), exhaust gas (e.g., vehicle exhaust gas), direct air capture, or a combination thereof. The steam can be generated by heating water to its boiling point, typically using in-line steam generator with any suitable heat source, or via introduction of liquid water downhole whereby the water converts to steam under downhole conditions. The method can thus include introducing the water as liquid water, whereby the introduced water is converted to (e.g., superheated) steam at the downhole conditions proximate the fractures 105, and/or the water can be introduced downhole as steam.

The high temperature and presence of the catalyst $C_{III}$ can facilitate the reaction between $CO_2$ and steam.

In such embodiments, the one or more reactants comprise carbon dioxide ($CO_2$) (e.g., first reactant $R1_{III}$), methane ($CH_4$), and $H_2O$ (e.g., steam or liquid water; second reactant $R2_{III}$), and hydrogen is produced downhole via catalytic reaction of $CO_2$ and methane via the reaction represented by Eq. (6):

$$CO_2+CH_4 \rightarrow 2CO+2H_2. \quad \text{(Eq. 6)}$$

The carbon monoxide (CO) reacts with $H_2O$ via the water gas shift reaction (WGSR) of Eq. (7) (and Eq. (2) above):

$$CO+H_2O \rightarrow CO_2+H_2, \quad \text{(Eq. 7)}$$

such that a net reaction can be represented as:

$$CH_4+H_2O \rightarrow CO+3H_2, \quad \text{(Eq. 8)}$$

Instead of injecting methane gas into the subterranean formation, natural gas existing in the formation provides a source of methane. The subterranean formation 110 can further comprise hydrocarbons, such that the $O_2$ further reacts with hydrocarbons in the formation 110 (e.g., via gasification) to provide heat and produce additional $H_2$, CO, $CO_2$, and/or $H_2O$ (e.g., steam, water vapor), and the produced CO and $H_2O$ (e . . . , produced via the gasification) can react (e.g., via the WGSR of Eq. 7) to produce additional $CO_2$ and $H_2$(g).

The method can further comprise recovering a product $P_{III}$ comprising at least a portion of the hydrogen produced in the fractures. The product $P_{III}$ can further comprise water (e.g., unreacted steam), hydrocarbons, carbon monoxide (CO), carbon dioxide ($CO_2$), or a combination thereof.

After the hydrogen production occurs, the product $P_{III}$, including hydrogen ($H_2$), and non-hydrogen components (e.g., carbon monoxide (CO), carbon dioxide (CO2), and any unreacted steam), can exit through the production well(s). In separator 109, the product $P_{III}$ mixture can be cooled to condense and separate the water vapor (steam) from the gases. Condensation can be achieved by using cooling systems or passing the gases through heat exchangers that in turn can be used to generate electrical power through the use of organic Rankine cycle generation units or other suitable method.

Hydrogen can be separated from the other non-hydrogen gases, including carbon monoxide and carbon dioxide, to obtain high-purity hydrogen 108. As noted above, various purification techniques can be employed, such as pressure swing adsorption (PSA), membrane separation, or selective catalytic reactions to remove impurities. The purified hydrogen 108 can be stored and utilized for various applications (e.g., in hydrogen usage apparatus 111), such as a fuel for powering combustion engines, fuel cells for generating electricity, industrial processes in generating chemicals or products, or supporting transportation. The non-hydrogen components, such as separated carbon monoxide, carbon dioxide, and water (from unreacted steam), can be reinjected into injection well(s) 101.

As noted above, in these embodiments, steam can (e.g., also) be obtained downhole by injecting water into the injection well 101 and allowing water to adsorb heat from the tight formation 110 to transform it into steam. The steam-to-methane ratio can be adjusted for optimal performance. A ratio of approximately 3:1 (steam to methane) can be utilized. Nickel-based catalyst Cm can be utilized to enhance the kinetics of the steam-$CO_2$ reaction (Eq. (6)).

In embodiments, the fractures 105 can be exposed to a formation temperature (e.g., a bottom hole temperature (BHT)) of greater than or equal to about 100° C., 150° C., 200° C. or 250° C. (e.g., from about 100 to about 150° C., from about 150° C. to about 200° C., or from about 200° C. to about 250° C.), a pressure (e.g., a bottom hole pressure (BHP)) of greater than or equal to about 5000, 10000, or 15000 psi (e.g., from about 5000 to about 7500 psig, from about 7500 to about 10000 psig, or from about 10000 psig to about 15000 psig), or a combination thereof.

Embodiment IV

In this embodiment IV, heat and in situ combustion (e.g., partial combustion of methane to produce $H_2$) can be utilized to increase the heat. This Embodiment IV essentially provides steam methane reforming (SMR) without the need to introduce steam downhole (e.g., the steam and heat are made/provided in situ in the formation 110).

Figure 3D:
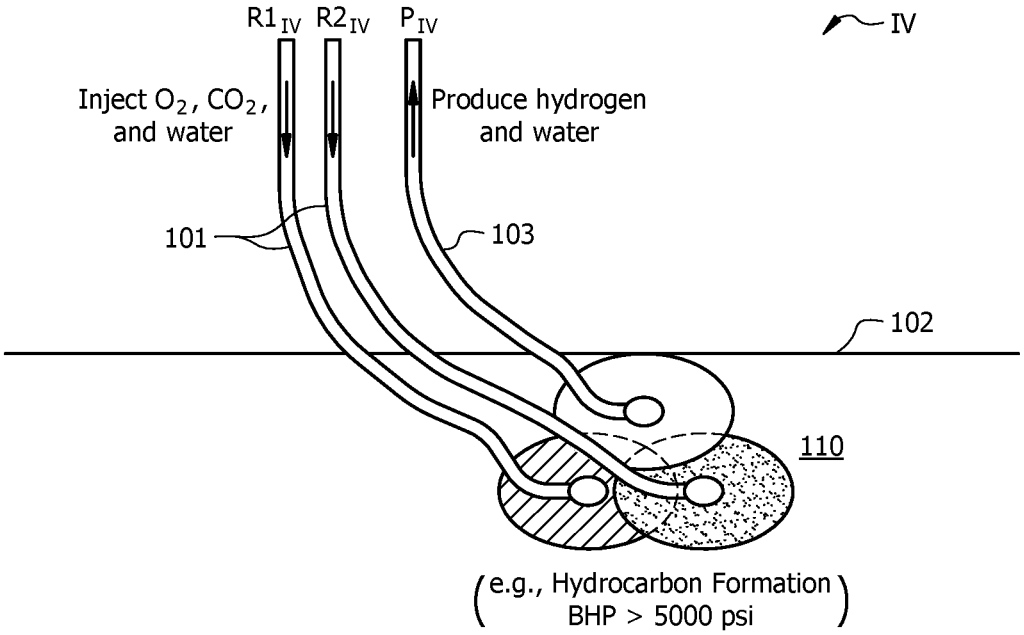
FIG. 3D is a schematic of a system IV, according to embodiments of this disclosure.

With reference to the embodiment of FIG. 3D, which is a schematic of a system IV according to embodiments of this disclosure, a system IV can include one or more injection wells 101 and one or more production wells 103. System IV can be a system 100 as described with reference to FIG. 2, further characterized as described hereinbelow. Hydrogen can be generated in-situ from a tight reservoir formation 110 containing hydrocarbon via system IV.

In these embodiments, the subterranean formation 110 can contain hydrocarbons (e.g., methane). The one or more reactants R ($R1_{IV}$, $R2_{IV}$, $R3_{IV}$, etc.) can include comprise carbon dioxide ($CO_2$), oxygen ($O_2$), and water ($H_2O$), wherein in situ combustion of hydrocarbons in the formation 110 can be utilized to further heat the subterranean formation 110, such that gasification and/or water gas shift reactions noted above occur to produce a product $P_{IV}$ comprising the hydrogen ($H_2$), and non-hydrogen components including hydrocarbons, carbon monoxide (CO), $CO_2$, and steam (e.g., water vapor).

Reactants R can include a mixture of oxygen (e.g., as first reactant $R1_{IV}$), $CO_2$ (e.g., as second reactant $R2_{IV}$), and steam (e.g., as third reactant $R3_{IV}$) that can be injected into the injection well(s) 101. The oxygen reactant can be obtained from the air, $CO_2$ reactant can be obtained from various sources, such as flue gas (e.g., of industrial processes), exhaust gas (e.g., of vehicles), or direct air capture, and steam reactant can be generated by heating water to its boiling point, typically using in-line steam generator with any suitable heat source and/or introducing liquid water downhole such that it converts to steam under downhole conditions.

In situ combustion of hydrocarbon in the formation 110 can occur as the injected oxygen reacts with hydrocarbon in the formation 110. The heat generated from this combustion contributes to heating of the formation 110. Heating and increasing the temperature of the formations 110 by steam facilitate the gasification and/or water-gas shift (WGS) reactions between the hydrocarbon and water in the formation. At elevated temperature, gasification and water-gas shift reactions occur to generate of hydrogen, carbon monoxide, carbon dioxide, and steam (water vapor). WGS reaction (Eq. (2)/(7) above) converts carbon monoxide (CO) and water ($H_2O$) into carbon dioxide ($CO_2$) and hydrogen gas ($H_2$). The carbon dioxide injection can provide a source of CO for the WGS reaction.

The method can produce a product $P_{IV}$ comprising hydrogen, other gases, water vapor, and hydrocarbon, through production well(s) 103. The hydrogen and hydrocarbon can be separated, collected, and used in various applications. Carbon monoxide, carbon dioxide, and water vapor can be reinjected into injection well(s) 101.

The method can thus include separating the product $P_{IV}$ into a hydrocarbon stream comprising hydrocarbons, a fluid stream comprising CO, $CO_2$, and water vapor, and a purified hydrogen 108, wherein the purified hydrogen 108 comprises a greater concentration of hydrogen than the product $P_{IV}$. At least a portion of the fluid stream can be returned downhole via the injection well(s) 101 with the one or more reactants R to produce additional hydrogen.

In embodiments, the WGSR can be facilitated via a catalyst $C_{IV}$ that catalyzes the WGSR. Such a catalyst $C_{IV}$ can comprise a transition metal or metal oxide catalyst that enables the conversion of CO and $H_2O$ to $H_2$ and $CO_2$ via the WGSR (e.g., Eq. 7; $CO+H_2O \rightarrow H_2+CO_2$) to proceed at lower temperatures.

In this (and other) embodiments, the introduction of the one or more reactants R (e.g., comprising the steam and $CO_2$) and the production of $H_2$ can provide enhanced oil or gas recovery from the subterranean formation 110 (e.g., the injected fluids can help mobilize and extract hydrocarbons from the tight reservoir 110 matrix, increasing production rates and ultimate recovery of the hydrocarbons).

In embodiments, the fractures 105 can be exposed to a formation 110 temperature (e.g., a bottom hole temperature (BHT)) of greater than or equal to about 200° C., 250° C., or 350° C. (e.g., from about 200 to about 250° C., from about 250° C. to about 300° C., or from about 300° C. to about 350° C.), a pressure (e.g., a bottom hole pressure (BHP)) of greater than or equal to about 10000, 15000, or 25000 psi (e.g., from about 5000 to about 10000 psig, from about 10000 to about 15000 psig, or from about 15000 psig to about 25000 psig), or a combination thereof.

A system of this disclosure can comprise: one or more injection wells 101; one or more production wells 103; a plurality of fractures 105 extending within a tight formation 110 (e.g., within an area 116) between each of the one or more injection wells 101 and at least one of the one or more production wells 103; a source of one or more reactants R fluidly connected with the one or more injection wells 101; and a pump 107 configured to inject the one or more reactants R downhole via the one or more injection wells 101, wherein the one or more reactants R react, optionally with one or more additional reactants R located in the formation 110, to produce hydrogen in situ, wherein a product P comprising the produced hydrogen enters the one or more production wells 103, and wherein the plurality of fractures 105 provide a (e.g., large) surface area for heat transfer from the tight formation 110 to the one or more reactants R in the plurality of fractures 105.

In embodiments of the system, a catalyst C can be positioned in at least a portion of the fractures 105, wherein the catalyst catalyzes the in situ production of hydrogen. The plurality of fractures 105 operate as a fixed bed or a circulating bed reactor. In fixed catalyst bed embodiments, the catalyst C (e.g., $C_I$-$C_{IV}$) can remain in the fractures 105. In circulating catalyst bed embodiments, all or a portion of the catalyst particles C can be produced back to the surface 102, optionally separated and/or regenerated, and placed back downhole (e.g., along with additional reactant R) for use in in situ production of additional hydrogen downhole.

The tight formation 110 can have (e.g., be defined as having) a permeability of less than or equal to about 0.0001, 0.1, or 10 microDarcy (μD), a porosity of less than or equal to about 2, 4, or 6%, or a combination thereof. The catalyst C can be coated on proppant $P_R$ propping open at least a portion of the plurality of fractures 100. One or more of the production well(s) 103 can be operable as a storage well for the product P comprising the produced hydrogen.

The plurality of fractures 105 can comprise injection well fractures 105A associated with the one or more injection wells 101 and production well fractures 105B associated with the one or more production wells 103, and further comprising a portion of the formation 110 and/or a bed 116 of material positioned between the injection well fractures 105A, and production well fractures 105B, wherein the portion of the formation 110 and/or the bed of material 116 can be configured to remove one or more non-hydrogen components from the product P prior to entry thereof into the one or more production wells 103.

The system can include downstream apparatus 115 including separation apparatus 109 and/or hydrogen usage apparatus 111. A separation apparatus 109 can be configured for separating one or more non-hydrogen components 117 of the product P to provide a high-purity hydrogen 108 comprising at least a portion of the hydrogen in the product P, wherein the high-purity hydrogen 108 comprises a greater concentration of hydrogen than the product P. The separator 109 can comprise a condenser, a pressure swing adsorption (PSA) apparatus, a membrane, a selective catalytic reactor, or a combination thereof. For example, the non-hydrogen component 117 can comprise water, and the separation apparatus 109 can include a condenser configured to cool the product to condense water from the product P. The separation apparatus 109 can include power generation apparatus configured to produce power from the heat of the product P. The power generation apparatus comprises an organic Rankine cycle waste heat recovery system and/or a turbine configured to generate electrical power directly, and/or one or more heat exchangers.

A recycle path (e.g., recycle line(s) 118) can be configured for reintroducing at least one of the one or more non-hydrogen components 117 (e.g., catalyst, unreacted reactant(s), CO, $CO_2$, $H_2O$, hydrocarbons) downhole for the formation of additional hydrogen in the plurality of fractures 105.

The system can comprise hydrogen utilization apparatus configured to utilize at least a portion of the hydrogen in the product as a fuel (e.g., a combustion engine (e.g., fueling wellbore servicing equipment at a wellsite)), a fuel cell (e.g., for generating electricity, such as an automobile fuel cell), a fuel cell to produce electricity to power e-frac systems to fracture gas wells to produce methane, or a combination thereof.

Various catalysts and reactants of systems of this disclosure can be as described above with reference to the methods.

Figure 4:
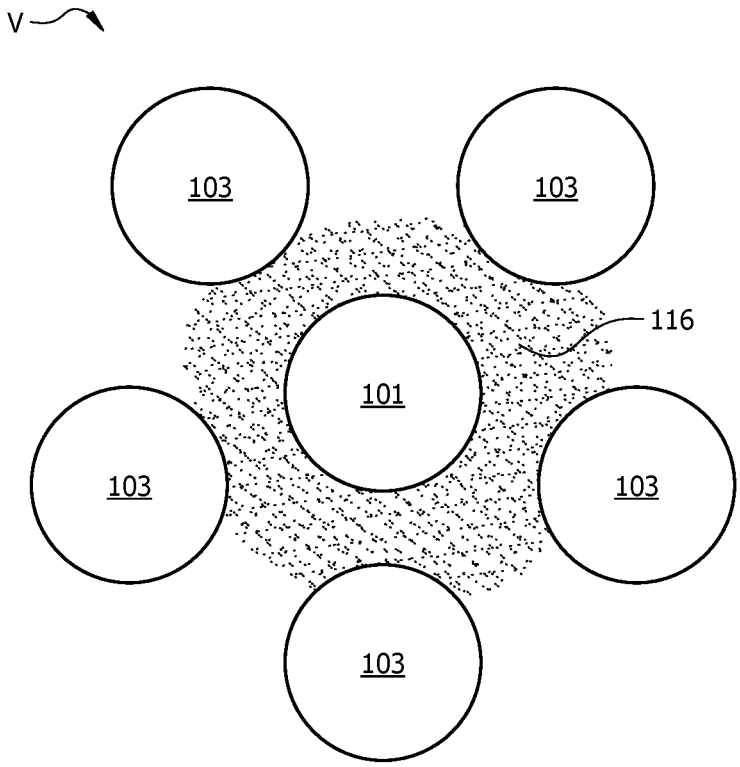
FIG. 4 is a schematic of a multi-well system V, according to embodiments f this disclosure.

With reference to FIG. 4, which is a schematic of a multi-well system V, according to embodiments of this disclosure, a system 100/I/II,III,IV of this disclosure can include any number of production wells 103 associated with each injection well 101 of any number of injection wells 101. In the system V of FIG. 4, four production wells are situated about an injection well 101. The area 116 between the injection well 101 and the production well(s) 103 can be utilized (e.g., designed, manipulated, sized, and/or located) to remove one or more non-hydrogen components 117 from the product P, in embodiments. One or more storage wells can be arranged around injection well(s) 101, for storage of the product P and/or the separated hydrogen 108.

The systems and methods of this disclosure provide for taking advantage of heat available in high-temperature reservoir formations to enhance in situ reactions for generating hydrogen by reacting different materials that can be injected into the downhole environment. In embodiments, a large surface area can be produced in the subsurface formation to further promote and enhance chemical reactions in the subsurface. Conventionally, production of hydrogen is effected in large chemical plants that produce a substantial amount of air pollutants, including carbon dioxide These plants have a large area footprint, often covering several acres of land. Via this disclosure, such land can be left in its natural state or used for agricultural purposes, as the reactions for producing hydrogen are moved below ground.

The disclosed systems and methods enable distributed hydrogen production. For example, a system 100/I/II/III/IV/V of this disclosure can be positioned at a fuel cell refilling station (e.g., similar to conventional "gas station"), such that hydrogen for refilling automobile fuel cells can be produced proximate (e.g., beneath) the fuel cell refilling station. Such facilitates fuel cell use for automobiles and reduces the need for hydrogen transport.

Many modifications or expansions upon the invention and the various illustrative embodiments described in this application still fall within the spirit and scope of the invention, and should be so considered.

Additional Disclosure

The following are non-limiting, specific embodiments in accordance with the present disclosure:

In a first embodiment, a method (of producing hydrogen downhole in a subterranean reaction zone, the method) comprising: fracturing a subterranean formation to provide fractures in the subterranean formation (e.g., to produce the subterranean reaction zone comprising fracture volume provided by the fractures), wherein the subterranean comprises a tight formation; and introducing one of more reactants downhole into the fractures (e.g., into the subterranean reaction zone), whereby hydrogen is produced by reaction of the one or more reactants in situ in the fractures (e.g., in situ in the reaction zone).

A second embodiment can include the method of the first embodiment, wherein the tight formation has a permeability of less than or equal to about 0.0001, 0.1, or 10 microDarcy (μD), a porosity of less than or equal to about 2, 4, or 6%, or a combination thereof.

A third embodiment can include the method of the first or the second embodiment, further comprising placing a catalyst within at least a portion of the fractures in the subterranean formation.

A fourth embodiment can include the method of the third embodiment, wherein placing the catalyst within the at least the portion of the fractures in the subterranean formation is effected during and/or subsequent fracturing the subterranean formation.

A fifth embodiment can include the method of the fourth embodiment, wherein fracturing the formation comprises introducing a fracturing fluid comprising a proppant into the subterranean formation, wherein proppant props open at least a portion the fractures.

A sixth embodiment can include the method of the fifth embodiment, wherein the proppant comprises (e.g., is coated with) a catalyst that catalyzes one or more reactions that produce the hydrogen.

A seventh embodiment can include the method of the fifth or sixth embodiment, wherein fracturing the subterranean formation comprises: drilling one or more injection wells; drilling one or more production wells; and producing the fractures in the subterranean formation by fracturing the one or more injection wells, the one or more production wells, or both (e.g., by increasing the pressure of the fracturing fluid in the injection and/or production wells and surrounding formation to greater than the fracture gradient of the formation), such that the fractures extend within the subterranean formation between each of the one or more injection wells and at least one of the one or more production wells.

An eighth embodiment can include the method of any one of the first to seventh embodiments, further comprising recovering a product (e.g., recovering a reaction product stream downhole and/or at the surface via the one or more production wells) comprising at least a portion of the hydrogen produced in the fractures.

A ninth embodiment can include the method of the eighth embodiment, further comprising separating one or more non-hydrogen components of the product therefrom to provide a high-purity hydrogen comprising at least a portion of the hydrogen in the product, wherein the high-purity hydrogen comprises a greater concentration of hydrogen than the product.

A tenth embodiment can include the method of the ninth embodiment, wherein the separating of the one or more non-hydrogen components from the product is effected via condensation, pressure swing adsorption (PSA), membrane separation, selective catalytic reaction(s), or a combination thereof.

An eleventh embodiment can include the method of the tenth embodiment, wherein the product comprises $H_2O$, and wherein separating of the one or more non-hydrogen components from the product comprises cooling the product to condense water from the product.

A twelfth embodiment can include the method of the eleventh embodiment, wherein the cooling comprises power generation (e.g., via the use of an organic Rankine cycle waste heat recovery system and/or turning a turbine to generate electrical power directly, and/or passing the product through one or more heat exchangers (e.g., and optionally using the heat to generate electrical power, for example via a geothermal cycle comprising steam turbine electrical generators)).

A thirteenth embodiment can include the method of any one of the ninth to twelfth embodiments, further comprising reintroducing at least one of the one or more non-hydrogen components (e.g., catalyst, unreacted reactant(s), CO, $CO_2$, $H_2O$, hydrocarbons) downhole during formation of additional hydrogen in the fractures; recycling $CO_2$ separated as a non-hydrogen component to the process; injecting the $CO_2$ separated as a non-hydrogen component for enhanced oil recovery techniques; or a combination thereof.

A fourteenth embodiment can include the method of any one of the eighth to thirteenth embodiments, further comprising storing at least a portion of the hydrogen in the product (e.g., at the surface and/or downhole in a portion of the subterranean formation (i) in fluid communication with the fractures comprising the hydrogen production/reaction zone and (ii) configured for hydrogen storage, for example via one or more methods disclosed in co-pending U.S. patent application Ser. No. 18/390,710, filed concurrently herewith and incorporated by reference herein in its entirety), utilizing at least a portion of the hydrogen in the product as a fuel (e.g., combusting $H_2$ as a fuel for powering a combustion engine (e.g., fueling wellbore servicing equipment at a wellsite)), utilizing at least a portion of the $H_2$ in the product in a fuel cell (e.g., for generating electricity; to re-fuel a hydrogen fuel cell such as re-filling an automobile fuel cell), utilizing at least a portion of the $H_2$ in the product in an industrial process (e.g., for the production of one or more chemicals), utilizing at least a portion of the $H_2$ in the product for re-filling fuel cells and utilizing the fuel cells to produce electricity to power e-frac systems to fracture wells to produce hydrocarbons (e.g., fracture a gas well to produce methane), or a combination thereof.

A fifteenth embodiment can include the method of any one of the first to fourteenth embodiments, wherein the one or more reactants comprise water ($H_2O$), and wherein the hydrogen is produced in the fractures via reaction of $H_2O$ with methane via steam methane reforming (SMR):

$$CH_4+H_2O \rightarrow CO+3H_2.$$

A sixteenth embodiment can include the method of the fifteenth embodiment, wherein the carbon monoxide produced via the steam methane reforming reaction further reacts with water/steam via the water gas shift reaction (WGSR): $CO+H_2O \rightarrow CO_2+H_2$, such that a net reaction is $CH_4+2H_2O \rightarrow CO_2+4H_2$.

A seventeenth embodiment can include the method of the fifteenth or sixteenth embodiment, wherein the one or more reactants introduced downhole further comprise methane, wherein the subterranean formation comprises methane, or both wherein the one or more reactants introduced downhole further comprise methane and wherein the subterranean formation comprises methane.

An eighteenth embodiment can include the method of any one of the fifteenth to seventeenth embodiments, further comprising recovering a product comprising at least a portion of the hydrogen, wherein the product optionally further comprises carbon monoxide, carbon dioxide, unreacted methane, $H_2O$ (e.g. steam, water), or a combination thereof.

A nineteenth embodiment can include the method of any one of the fifteenth to eighteenth embodiments, wherein the production of the hydrogen in the fractures is catalyzed by a catalyst comprising a nickel-based catalyst, an iron-based catalyst, a cobalt-based catalyst, or a combination thereof.

A twentieth embodiment can include the method of the nineteenth embodiment, further comprising positioning the catalyst in at least a portion of the fractures.

A twenty first embodiment can include the method of any one of the fifteenth to twentieth embodiments, wherein the fractures are exposed to a formation temperature (e.g., a bottom hole temperature (BHT)) of greater than or equal to about 200° C., 250° C., or 350° C. (e.g., from about 200 to about 250° C., from about 250° C. to about 300° C., or from about 300° C. to about 350° C.), a pressure (e.g., a bottom hole pressure (BHP)) of greater than or equal to about 10000, 15000, or 25000 psi (e.g., from about 5000 to about 10000 psig, from about 10000 to about 15000 psig, or from about 15000 psig to about 25000 psig), or a combination thereof.

A twenty second embodiment can include the method of any one of the first to fourteenth embodiments, wherein the one or more reactants comprise aluminum particulates (e.g., aluminum particulates having a high surface to volume ratio (e.g., a surface to volume ratio of greater than or equal to about 0.1, 3, or 6, or from about 0.1 to about 2, from about 2 to about 4, or from about 4 to about 6), such as aluminum flakes, sawdust, milling shavings, chips, pellets, powder, or a combination thereof) and water, and wherein hydrogen is produced downhole via catalytic reaction of aluminum with water in the presence of a catalyst comprising metal hydroxide, metal oxide, or a combination thereof.

A twenty third embodiment can include the method of the twenty second embodiment, wherein the catalytic reaction of aluminum with water comprises: $2Al+3H_2O \rightarrow Al_2O_3+3H_2$ (Eq. 1); $2Al+6H_2O \rightarrow 2Al(OH)_3+3H_2$ (Eq. 2); or a combination thereof.

A twenty fourth embodiment can include the method of the twenty third embodiment, wherein the metal hydroxide is selected from sodium hydroxide, potassium hydroxide, calcium hydroxide, magnesium hydroxide, or a combination thereof, wherein the metal oxide is selected from sodium oxide, potassium oxide, calcium oxide, magnesium oxide, or a combination thereof, or wherein the metal hydroxide is selected from sodium hydroxide, potassium hydroxide, calcium hydroxide, magnesium hydroxide, or a combination thereof and wherein the metal oxide is selected from sodium oxide, potassium oxide, calcium oxide, magnesium oxide, or a combination thereof.

A twenty fifth embodiment can include the method of any one of the twenty second to twenty fourth embodiments, further comprising recovering a product comprising at least a portion of the hydrogen produced in the fractures, wherein the product optionally further comprises aluminum oxide solids, aluminum hydroxide solids, $H_2O$ (e.g. steam, water), or a combination thereof.

A twenty sixth embodiment can include the method of any one of the twenty second to twenty fifth embodiments, further comprising: introducing (e.g., injecting) an aqueous-based solution containing the catalyst (e.g., liquid metal hydroxide) into an injection well; introducing (e.g., injecting) a slurry comprising (e.g., a known concentration of) the aluminum particulates (e.g., aluminum nanoparticles) in (e.g., an aqueous or a non-aqueous (e.g., ethylene glycol)) carrier fluid into the injection well; allowing the catalytic reaction to occur between the aluminum particulates and water in the presence of the catalyst to produce the hydrogen as a gas and byproduct aluminum oxide and/or aluminum hydroxide solids; and producing a product comprising $H_2O$ and at least a portion of the hydrogen via a production well.

A twenty seventh embodiment can include the method of the twenty sixth embodiment, wherein the product further comprises at least a portion of the byproduct aluminum oxide and/or aluminum hydroxide solids.

A twenty eighth embodiment can include the method of any one of the twenty second to twenty seventh embodiments, further comprising injecting additional water and aluminum particulates downhole to maintain a target production rate and/or temperature in the fractures.

A twenty ninth embodiment can include the method of any one of the twenty second to twenty eighth embodiments, wherein the fractures are exposed to a formation temperature (e.g., a bottom hole temperature (BHT)) of greater than or equal to about 100° C., 150° C., 200° C., or 250° C. (e.g., from about 100 to about 150° C., from about 150° C. to about 200° C., or from about 200° C. to about 250° C.), a pressure (e.g., a bottom hole pressure (BHP)) of greater than or equal to about 5000, 10000, or 15000 psi (e.g., from about 5000 to about 7500 psig, from about 7500 to about 10000 psig, or from about 10000 psig to about 15000 psig), or a combination thereof.

A thirtieth embodiment can include the method of any one of the first to fourteenth embodiments, wherein the one or more reactants comprise carbon dioxide ($CO_2$), methane ($CH_4$), and $H_2O$ (e.g., steam or liquid water), and wherein hydrogen is produced downhole via catalytic reaction of $CO_2$ and methane via the reactions: $CO_2+CH_4 \rightarrow 2CO+2H_2$.

A thirty first embodiment can include the method of the thirtieth embodiment, wherein the carbon monoxide (CO) further reacts with $H_2O$ via the water gas shift reaction (WGSR): $CO+H_2O \rightarrow CO_2+H_2$, such that a net reaction can be represented as: $CH_4+H_2O \rightarrow CO+3H_2$.

A thirty second embodiment can include the method if the thirty first embodiment, wherein the subterranean formation further comprises hydrocarbons, and wherein the $O_2$ further reacts with hydrocarbons in the formation (e.g., via gasification) to produce additional $H_2$, CO, $CO_2$, and/or $H_2O$ (e.g., steam, water vapor), and the produced CO and $H_2O$ (e . . . , produced via the gasification) can react (e.g., via the WGSR) to produce additional $CO_2$ and $H_2$(g).

A thirty third embodiment can include the method of any one of the thirtieth to thirty second embodiments, further comprising recovering a product comprising at least a portion of the hydrogen produced in the fractures, wherein the product optionally further comprises carbon monoxide (CO), carbon dioxide ($CO_2$), unreacted steam, hydrocarbons, or a combination thereof.

A thirty fourth embodiment can include the method of any one of the thirtieth to thirty third embodiments, comprising introducing the water as liquid water, whereby the introduced water is converted to (e.g., superheated) steam at the downhole conditions proximate the fractures.

A thirty fifth embodiment can include the method of any one of the thirtieth to thirty fourth embodiments, wherein the fractures are exposed to a formation temperature (e.g., a bottom hole temperature (BHT)) of greater than or equal to about 100° C., 150° C., 200° C. or 250° C. (e.g., from about 100 to about 150° C., from about 150° C. to about 200° C., or from about 200° C. to about 250° C.), a pressure (e.g., a bottom hole pressure (BHP)) of greater than or equal to about 5000, 10000, or 15000 psi (e.g., from about 5000 to about 7500 psig, from about 7500 to about 10000 psig, or from about 10000 psig to about 15000 psig), or a combination thereof.

A thirty sixth embodiment can include the method of any one of the thirtieth to thirty fifth embodiments, wherein the $CO_2$ reactant is obtained from a flue gas (e.g., from an industrial process), exhaust gas (e.g., vehicle exhaust gas), direct air capture, or a combination thereof, wherein the $H_2O$ reactant is introduced as steam, produced by heating the $H_2O$ above the boiling point of water, or is introduced as $H_2O$(liquid) and heated above the boiling point at conditions downhole to form steam; or a combination thereof.

A thirty seventh embodiment can include the method of any one of the thirtieth to thirty sixth embodiments, wherein the hydrogen is produced in the presence of a nickel-based catalyst.

A thirty eighth embodiment can include the method of any one of the first to fourteenth embodiments, wherein the subterranean formation comprises hydrocarbons, wherein the one or more reactants comprise carbon dioxide ($CO_2$), oxygen ($O_2$), and water ($H_2O$), wherein in situ combustion of hydrocarbons in the formation occurs to further heat the subterranean formation, such that gasification and/or water gas shift reactions occur to produce a product comprising the hydrogen ($H_2$), hydrocarbons, carbon monoxide (CO), $CO_2$, and steam (e.g., water vapor).

A thirty ninth embodiment can include the method of the thirty eighth embodiment, further comprising separating the product into a hydrocarbon stream comprising hydrocarbons, a fluid stream comprising CO, $CO_2$, and water vapor, and a purified hydrogen, wherein the purified hydrogen comprises a greater concentration of hydrogen than the product.

A fortieth embodiment can include the method of the thirty ninth embodiment, further comprising recycling at least a portion of the fluid stream downhole with the one or more reactants.

A forty first embodiment can include the method of any one of the thirty eighth to fortieth embodiment, further comprising facilitating the WGSR via a catalyst that catalyzes the WGSR (e.g., a transition metal or metal oxide catalyst that enables the conversion of CO and $H_2O$ to $H_2$ and $CO_2$ via the WGSR (e.g., $CO+H_2O \rightarrow H_2+CO_2$) to proceed at lower temperatures).

A forty second embodiment can include the method of any one of the thirty eighth to forty first embodiments, wherein the introduction of the one or more reactants comprising the steam and $CO_2$ and the production of $H_2$ provide enhanced oil or gas recovery from the subterranean formation (e.g., the injected fluids help mobilize and extract hydrocarbons from the tight reservoir matrix, increasing production rates and ultimate recovery of the hydrocarbons).

A forty third embodiment can include the method of any one of the thirty eighth to forty second embodiments, wherein the fractures are exposed to a formation temperature (e.g., a bottom hole temperature (BHT)) of greater than or equal to about 200° C., 250° C., or 350° C. (e.g., from about 200 to about 250° C., from about 250° C. to about 300° C., or from about 300° C. to about 350° C.), a pressure (e.g., a bottom hole pressure (BHP)) of greater than or equal to about 10000, 15000, or 25000 psi (e.g., from about 5000 to about 10000 psig, from about 10000 to about 15000 psig, or from about 15000 psig to about 25000 psig), or a combination thereof.

In a forty fourth embodiment, a system comprises: one or more injection wells; one or more production wells; a plurality of fractures extending within a tight formation between each of the one or more injection wells and at least one of the one or more production wells (wherein the plurality of fractures provide fracture volume forming a subterranean reaction zone); a source of one or more reactants fluidly connected with the one or more injection wells (and the subterranean reaction zone); and a pump configured to inject the one or more reactants downhole (into the subterranean reaction zone) via the one or more injection wells, wherein the one or more reactants react (within the subterranean reaction zone), optionally with one or more additional reactants present within the formation and/or reaction zone, to produce hydrogen in situ, wherein a product comprising the produced hydrogen enters the one or more production wells (and is produced at the surface as a product stream that may undergo additional processes such as separation, etc.), and wherein the plurality of fractures provide a (e.g., large) surface area for heat transfer from the tight formation to the one or more reactants in the plurality of fractures (e.g., wherein the fracture surfaces/walls provide surface area in an amount sufficient to provide for effective heat transfer to sustain the reaction of the one or more reactants in the reaction zone).

A forty fifth embodiment can include the system of the forty fourth embodiment, further comprising a catalyst (e.g., a catalytic proppant material) positioned in at least a portion of the fractures, wherein the catalyst catalyzes the in situ production of hydrogen.

A forty sixth embodiment can include the system of the forty fifth embodiment, wherein the plurality of fractures (e.g., within the reaction zone) operate as a fixed bed or a circulating bed reactor.

A forty seventh embodiment can include the system of any one of the forty fourth to forty sixth embodiments, wherein the tight formation has a permeability of less than or equal to about 0.0001, 0.1, or 10 microDarcy (μD), a porosity of less than or equal to about 2, 4, or 6%, or a combination thereof.

A forty eighth embodiment can include the system of any one of the forty fourth to forty seventh embodiments, wherein the catalyst is coated on proppant propping open at least a portion of the plurality of fractures.

A forty ninth embodiment can include the system of any one of the forty fourth to forty eighth embodiments, wherein the production well is operable as a storage well for the product comprising the produced hydrogen.

A fiftieth embodiment can include the system of any one of the forty fourth to forty ninth embodiments, wherein the plurality of fractures comprise injection well fractures associated with the one or more injection wells and production well fractures associated with the one or more production wells (e.g., the subterranean reaction zone formed by the fractures), and further comprising a portion of the formation and/or a bed of material positioned between the injection well fractures and production well fractures, wherein the portion of the formation and/or the bed of material is configured (as a subterranean separation zone) to remove one or more non-hydrogen components from the product prior to recovery of the product (e.g., entry thereof into the one or more production wells) and/or storage thereof (e.g., storage in a subterranean storage zone formed by fractures surfaces and associated volume in the tight formation).

A fifty first embodiment can include the system of any one of the forty fourth to fiftieth embodiments, further comprising a separator configured for separating one or more non-hydrogen components of the product therefrom to provide a high-purity hydrogen comprising at least a portion of the hydrogen in the product, wherein the high-purity hydrogen comprises a greater concentration of hydrogen than the product.

A fifty second embodiment can include the system of the fifty first embodiment, wherein the separator comprises a condenser, a pressure swing adsorption (PSA) apparatus, a membrane, a selective catalytic reactor, or a combination thereof.

A fifty third embodiment can include the system of the fifty first embodiment, wherein the non-hydrogen component comprises water, and wherein the separator comprises a condenser configured to cool the product to condense water from the product.

A fifty fourth embodiment can include the system of the fifty third embodiment, further comprising power generation apparatus configured to produce power from the heat.

A fifty fifth embodiment can include the system of the fifty fourth embodiment, wherein the power generation apparatus comprises an organic Rankine cycle waste heat recovery system and/or a turbine configured to generate electrical power directly, and/or one or more heat exchangers.

A fifty sixth embodiment can include the system of any one of the fifty first to fifty sixth embodiments, further comprising a recycle path (e.g., recycle line(s)) for reintroducing at least one of the one or more non-hydrogen components (e.g., catalyst, unreacted reactant(s), CO, $CO_2$, $H_2O$, hydrocarbons) downhole for the formation of additional hydrogen in the plurality of fractures; recycling $CO_2$ separated as a non-hydrogen component; injecting the $CO_2$ separated as a non-hydrogen component for enhanced oil recovery techniques; or a combination thereof.

A fifty seventh embodiment can include the system of any one of the forty fourth to fifty sixth embodiments, further comprising hydrogen utilization apparatus configured to utilize at least a portion of the hydrogen in the product as a fuel (e.g., a combustion engine (e.g., fueling wellbore servicing equipment at a wellsite)), a fuel cell (e.g., for generating electricity, such as an automobile fuel cell), a fuel cell to produce electricity to power e-frac systems to fracture gas wells to produce methane, or a combination thereof.

In a fifty eighth embodiment, a system comprises: one or more injection wells; one or more production wells; and a plurality of fractures extending within a tight formation between each of the one or more injection wells and at least one of the one or more production wells, wherein the plurality of fractures comprise fractures faces/surfaces defining fracture volume forming a subterranean reaction zone, a subterranean separation zone, a subterranean storage zone, or any combination thereof.

A fifty ninth embodiment can include the system of the fifty eighth embodiment, wherein the subterranean reaction zone is configured for the production of hydrogen (e.g., contains reactants, catalytic proppant material, and reaction conditions) in accordance with the methods described in any of Embodiments 1-4 herein (e.g., hydrogen is produced in situ the reaction zone in accordance with the method of any of first to forty third embodiments).

A sixtieth embodiment can include the system of the fifty eighth or fifty ninth embodiment, wherein the subterranean separation zone is configured to receive a hydrogen product from the subterranean reaction zone and remove at least a portion of unreacted reactants, non-hydrogen products, in-situ formation fluid, or any combination thereof from the hydrogen product formed in the reaction zone.

A sixty first embodiment can include the system of the sixtieth embodiment, wherein the subterranean separation zone comprises filter material configured and effective to filter the hydrogen product (e.g., to remove the at least a portion of unreacted reactants, non-hydrogen products, in-situ formation fluids, or any combination thereof), and wherein the filter material comprises a packed bed of particulate material (e.g., filter proppant) placed during the formation of the fractures (e.g., deposited by a filter proppant laden fracturing fluid).

A sixty second embodiment can include the system of any one of the fifty eighth to sixty first embodiments, wherein the subterranean storage zone is configured for the storage of hydrogen in accordance with any of the embodiments disclosed in co-pending U.S. patent application Ser. No. 18/390,710, filed concurrently herewith and incorporated by reference herein in its entirety.

In a sixty third embodiment, a method for forming the system of any of the fifty eighth to sixty second embodiments comprises drilling the one or more production wells and one or more injection wells in the subterranean formation, and pumping a fracturing fluid into the one or more production wells, the one or more injection wells or both to form a complex fracture structure in accordance with any of the embodiments disclosed in co-pending U.S. patent application Ser. No. 18/210,211 entitled Optimizing Well Placement to Maximize Exposed Hydraulic Fracture Area in Geothermal Wells, incorporated by reference herein in its entirety, wherein the complex fracture structure provides all or a portion of the subterranean reaction zone, the subterranean separation zone, the subterranean storage zone, or combinations thereof.

A sixty fourth embodiment can include the method of the sixty third embodiment further comprising placing catalytic proppant material in the subterranean reaction zone and//or placing filter proppant material in the subterranean separation zone.

In a sixty fifth embodiment, a method comprises: (a) contacting reactants in the subterranean reaction zone of any system of embodiment fifty eight to sixty two under reaction conditions sufficient to produce a reaction product comprising hydrogen, (b) optionally contacting all or a portion of the reaction product with the separation zone to remove one or more components from the reaction product to form a hydrogen rich product, (c) optionally storing all or a portion of the reaction product and/or the hydrogen rich product in the storage zone; and (d) optionally producing all or a portion of the reaction product and/or the hydrogen rich product to the surface via one or more of the production wells.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A method comprising:

fracturing a subterranean formation to provide fractures in the subterranean formation, wherein the subterranean comprises a tight formation, wherein the tight formation has a permeability of less than or equal to about 10 microDarcy (μD), a porosity of less than or equal to about 6%, or a combination thereof, and introducing one or more reactants selected from methane, carbon dioxide, oxygen, carbon monoxide, aluminum particulates, $H_2O$, or a combination thereof downhole into the fractures, whereby hydrogen is produced by reaction of the one or more reactants in situ in the fractures with each other and/or with one or more additional reactants present within the formation and selected from hydrocarbons and $H_2O$, and wherein downhole heating of the reactants consists of heat transfer from the tight formation to the one or more reactants in the plurality of fractures.

2. The method of claim 1, wherein the tight formation has the permeability of less than or equal to about 10 microDarcy (μD).

3. The method of claim 1 further comprising placing a catalyst within at least a portion of the fractures in the subterranean formation, wherein the catalyst catalyzes the reaction of the one or more reactants in situ in the fractures with each other and/or with the one or more additional reactants present within the formation.

4. The method of claim 3, wherein fracturing the formation comprises introducing a fracturing fluid comprising a proppant into the subterranean formation, wherein proppant props open at least a portion of the fractures.

5. The method of claim 4, wherein the proppant comprises the catalyst, wherein the catalyst catalyzes the reaction of the one or more reactants in situ in the fractures.

6. The method of claim 4, wherein fracturing the subterranean formation comprises:

drilling one or more injection wells;

drilling one or more production wells; and producing the fractures in the subterranean formation by fracturing the one or more injection wells, the one or more production wells, or both, such that the fractures extend within the subterranean formation between each of the one or more injection wells and at least one of the one or more production wells.

7. The method of claim 1 further comprising recovering at least a portion of the hydrogen produced in the fractures.

8. The method of claim 7 further comprising storing at least a portion of the hydrogen combusting at least a portion of the hydrogen as a fuel, introducing at least a portion of the $H_2$ in a fuel cell, reacting at least a portion of the $H_2$ in an industrial process, for re-filling fuel cells with at least a portion of the hydrogen and utilizing the re-filled fuel cells to produce electricity to power e-frac systems to fracture wells to produce hydrocarbons, or a combination thereof.

9. The method of claim 1, wherein the one or more reactants comprise water ($H_2O$), and wherein the hydrogen is produced in the fractures via reaction of $H_2O$ with methane via steam methane reforming (SMR): $CH_4+H_2O \rightarrow CO+3H_2$.

10. The method of claim 9, wherein the carbon monoxide produced via the steam methane reforming reaction further reacts with water/steam via the water gas shift reaction (WGSR):

$$CO+H_2O \rightarrow CO_2+H_2, \text{ such that a net reaction is } CH_4+2H_2O \rightarrow CO_2+4H_2.$$

11. The method of claim 9, wherein the one or more reactants introduced downhole further comprise methane, wherein the subterranean formation comprises methane, or both wherein the one or more reactants introduced downhole further comprise methane and wherein the subterranean formation comprises methane.

12. The method of claim 9, wherein the production of the hydrogen in the fractures is catalyzed by a catalyst comprising a nickel-based catalyst, an iron-based catalyst, a cobalt-based catalyst, or a combination thereof.

13. The method of claim 1, wherein the one or more reactants comprise aluminum particulates and water, and wherein hydrogen is produced downhole via catalytic reaction of aluminum with water in the presence of a catalyst comprising metal hydroxide, metal oxide, or a combination thereof.

14. The method of claim 13, wherein the catalytic reaction of aluminum with water comprises:

$$2Al+3H_2O \rightarrow Al_2O_3+3H_2 \quad \text{(Eq. 1);}$$

$$2Al+6H_2O \rightarrow 2Al(OH)_3+3H_2 \quad \text{(Eq. 2); or}$$

a combination thereof.

15. The method of claim 1, wherein the one or more reactants comprise carbon dioxide ($CO_2$), methane ($CH_4$), and $H_2O$, and wherein hydrogen is produced downhole via catalytic reaction of $CO_2$ and methane via the reactions: $CO_2+CH_4 \rightarrow 2CO+2H_2$.

16. The method of claim 15, wherein the carbon monoxide (CO) further reacts with $H_2O$ via the water gas shift reaction (WGSR):

$$CO+H_2O \rightarrow CO_2+H_2,$$

such that a net reaction can be represented as: $CH_4+H_2O \rightarrow CO+3H_2$.

17. The method of claim 16, wherein the subterranean formation further comprises hydrocarbons, and wherein the $O_2$ further reacts with hydrocarbons in the formation to produce additional $H_2$, CO, $CO_2$, and/or $H_2O$, and the produced CO and $H_2O$ can react to produce additional $CO_2$ and $H_2$(g).

18. The method of claim 1, wherein the subterranean formation comprises hydrocarbons, wherein the one or more reactants comprise carbon dioxide ($CO_2$), oxygen ($O_2$), and water ($H_2O$), wherein in situ combustion of hydrocarbons in the formation occurs to further heat the subterranean formation, such that gasification and/or water gas shift reactions occur to produce a product comprising the hydrogen ($H_2$), hydrocarbons, carbon monoxide (CO), $CO_2$, and steam.

19. The method of claim 1, wherein the subterranean formation has a bottom hole temperature (BHT) of about 100° C. to 350° C.

20. The method of claim 1, wherein the subterranean formation has a bottom hole temperature (BHT) of about 300° C. to 350° C.

* * * * *